US008186165B2

(12) United States Patent
Dinu

(10) Patent No.: US 8,186,165 B2
(45) Date of Patent: May 29, 2012

(54) TURBINE FUEL NOZZLE HAVING HEAT CONTROL

(75) Inventor: Constantin Dinu, Katy, TX (US)

(73) Assignee: General Electric Company, Schenectady, NY (US)

( * ) Notice: Subject to any disclaimer, the term of this patent is extended or adjusted under 35 U.S.C. 154(b) by 636 days.

(21) Appl. No.: 12/405,195

(22) Filed: Mar. 16, 2009

(65) Prior Publication Data

US 2010/0229556 A1 Sep. 16, 2010

(51) Int. Cl.
*F02C 1/00* (2006.01)

(52) U.S. Cl. ..... 60/743; 60/736; 60/740; 431/11; 431/208; 431/214; 239/5

(58) Field of Classification Search ..... 60/736, 60/740, 743; 431/11, 208, 214, 240
See application file for complete search history.

(56) References Cited

U.S. PATENT DOCUMENTS

| | | | | |
|---|---|---|---|---|
| 4,262,482 | A * | 4/1981 | Roffe et al. | 60/736 |
| 4,365,753 | A | 12/1982 | Harding et al. | |
| 4,392,811 | A * | 7/1983 | Ito | 431/37 |
| 5,461,865 | A * | 10/1995 | Snyder et al. | 60/737 |
| 6,547,163 | B1 | 4/2003 | Mansour et al. | |
| 6,601,776 | B1 * | 8/2003 | Oljaca et al. | 239/5 |
| 6,622,488 | B2 | 9/2003 | Mansour et al. | |
| 6,779,513 | B2 * | 8/2004 | Pellizzari et al. | 123/549 |
| 6,920,749 | B2 | 7/2005 | Mansour et al. | |
| 7,251,940 | B2 | 8/2007 | Graves et al. | |
| 7,266,945 | B2 * | 9/2007 | Sanders | 60/743 |
| 7,533,532 | B1 * | 5/2009 | Toon et al. | 60/740 |
| 2002/0083714 | A1 * | 7/2002 | Bakholdin | 60/776 |
| 2005/0223710 | A1 * | 10/2005 | Creighton et al. | 60/740 |
| 2010/0251720 | A1 * | 10/2010 | Pelletier et al. | 60/740 |

* cited by examiner

*Primary Examiner* — Ehud Gartenberg
*Assistant Examiner* — Michael B Mantyla
(74) *Attorney, Agent, or Firm* — Fletcher Yoder PC

(57) ABSTRACT

In one embodiment, a system includes a turbine engine fuel nozzle having an air path, a fuel path, and a surface along the air path. The fuel path may be directed toward the surface. The turbine engine fuel nozzle also may include a heating element configured to heat the surface.

20 Claims, 6 Drawing Sheets

TURBINE FUEL NOZZLE HAVING HEAT CONTROL

BACKGROUND OF THE INVENTION

The present disclosure relates generally to a system and arrangement for a fuel nozzle of a turbine engine and, more specifically, to improved fuel injection, fuel air mixing, and combustion in the turbine engine.

Gas turbine engines combust a fuel air mixture to produce hot gases, which in turn drive a turbine to rotate a shaft coupled to one or more loads. As appreciated, the fuel air mixture significantly affects engine performance, fuel consumption, and emissions. In particular, inadequate atomization or vaporization of liquid fuel, non-uniform mixing of liquid or gas fuel, or both, may cause a decrease in power output, an increase in specific fuel consumption, and an increase in emissions. For example, the emissions may include nitrogen oxides (NOx), sulfur oxides (SOx), carbon monoxide, and particulate matter (PM). As fuel prices increase and emissions laws become stricter, optimal fuel injection and mixing becomes increasingly important to gas turbine engines. In addition, liquid fuels can cause coking on various surfaces, e.g., near fuel injection. As a result, the coking may reduce performance, and may require cleaning after an undesirable amount of buildup on the surfaces.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a turbine engine, that includes a turbine, a combustor, a compressor, and a fuel nozzle disposed in the combustor, wherein the fuel nozzle includes a heat control configured to control fuel vaporization, coking, or a combination thereof.

In a second embodiment, a system includes a fuel prefilmer configured to create a fuel film that sheds fuel in a turbine fuel nozzle, and a heat source configured to control fuel vaporization and coking associated with the fuel prefilmer.

In a third embodiment, a system includes a turbine engine fuel nozzle having an air path, a fuel path, and a surface along the air path. The fuel path may be directed toward the surface. The turbine engine fuel nozzle also may include a heating element configured to heat the surface.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
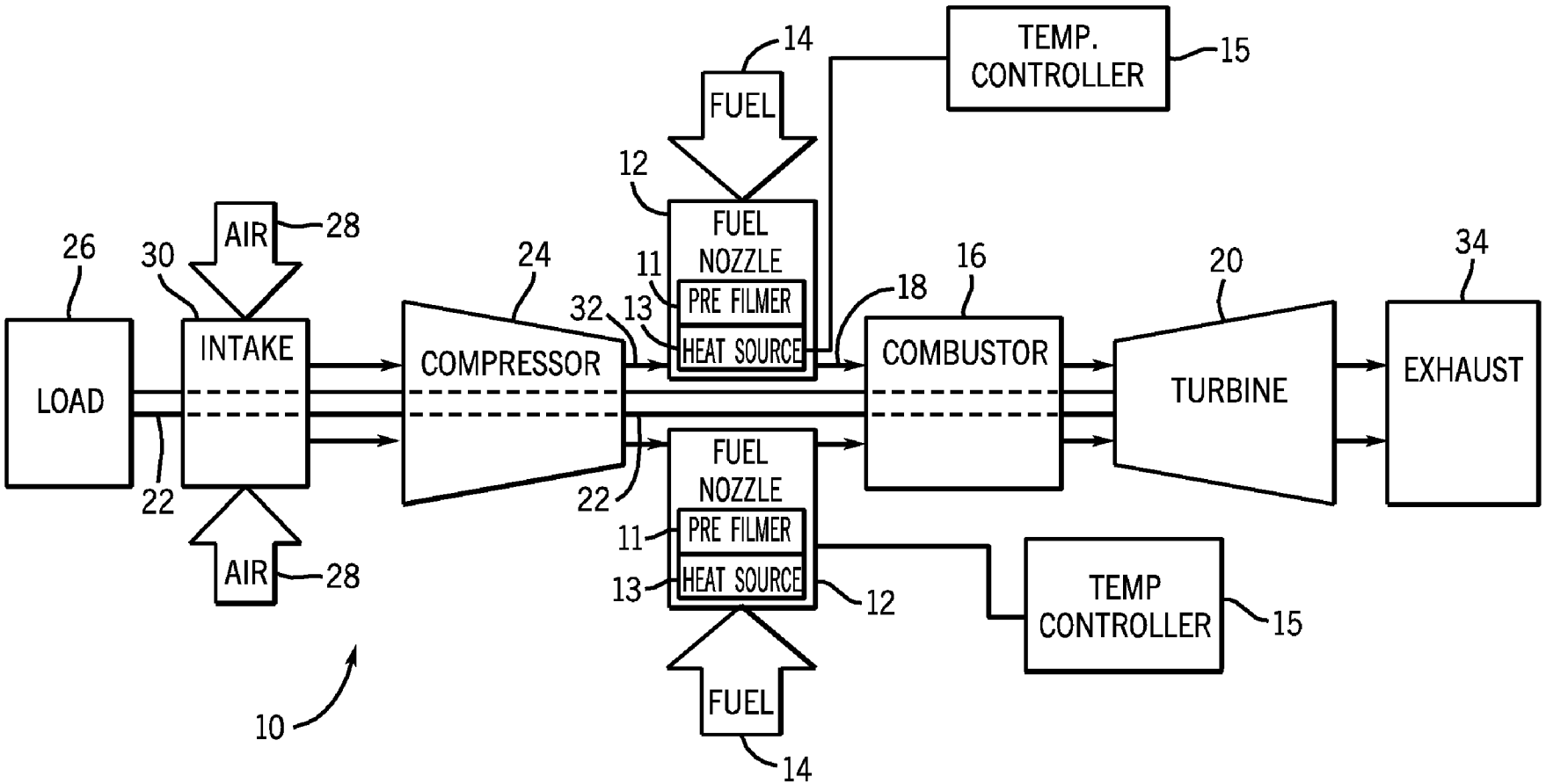
FIG. 1 is a block diagram of a turbine system having a fuel nozzle, including a prefilmer and heat source, coupled to a combustor in accordance with an embodiment of the present technique.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed in detail below, various embodiments of fuel nozzles may include one or more liquid fuel prefilmers with heat control to improve the performance of a turbine engine. A prefilmer may be defined as a mechanism configured to create a thin film of liquid fuel, which in turn sheds off into an air flow path. For example, the prefilmer may include a surface oriented along or against the air flow path, a liquid fuel supply may impinge or direct a liquid fuel onto the surface, the liquid fuel may thin across the surface, and the thinned liquid fuel may then shed from an edge of the surface. As appreciated, the thinning and shedding may improve liquid fuel vaporization and atomization. Improved vaporization and atomization can lead to a better mixture between air and fuel, which leads to improved combustion within the turbine engine. In addition, the heat control may improve vaporization while also reducing or eliminating coking of the liquid fuel.

In certain embodiments, as discussed below, the prefilmer may contain, or be coupled to, an active heat control device or source, such as a heating element, to further enhance atomization and vaporization. The heat source may include a resistive heater, an inductive heater, a radiative heater, or any suitable heating element. For example, the heat source may include an electric heater having one or more heating elements. By further example, the heat source may acquire heat from other areas in the turbine engine, e.g., convective heat transfer from the compressor, combustor, or turbine. As discussed below, the heat source may be used to perform a temperature and heat control of the area near or the surface of the prefilmer to adjust and improve a fuel vaporization process. Further, the heat source may be configured to maintain a suitable temperature to substantially or completely prevent coking, remove coking, or both. For example, the heat source may maintain a temperature above approximately 500, 600, 700, 800, 900, or 1000 degrees Fahrenheit (F) near the prefilmer. In certain embodiments, the heat source may maintain a temperature between approximately 500 to 1200, 700 to 1000, or 800 to 900 degrees Fahrenheit (F) near the prefilmer. For example, the temperature range or target temperature may be selected based on a desire to control fuel vaporization, or coking, or both. Thus, depending on the goal, the temperature range or target temperature may be greater or lesser.

In certain embodiments, as discussed below, the prefilmer may be coupled to a curved flow conditioner in the fuel nozzle and may also be curved and concentric to the flow conditioner. For example, the flow conditioner may be located at an upstream end portion of the fuel nozzle. In one embodiment, the prefilmer may be located further downstream, where it is coupled to a swirler inside the fuel nozzle. Alternatively, the prefilmer may include a plurality of members that may be located around a circumference of an annulus within the fuel nozzle. Further, the members of the prefilmer may be staggered axially along the nozzle annulus to ensure greater heat control, thereby enhancing the vaporization and atomization within the fuel nozzle.

Each of the various embodiments of prefilmers and active heat control sources enable improved air-fuel mixing via enhanced atomization and/or vaporization of the liquid fuel. Additionally, by controlling the heat of the area near the prefilmer and/or the prefilmer surface, the disclosed embodiments may improve both atomization and vaporization of fuel in the fuel nozzle, further improving turbine efficiency and reducing emissions. In addition, the heat control may also help avoid or remove coking of the prefilmer by providing a temperature greater than approximately 500, 600, 700, 800, 900, or 1000 degrees F., further enhancing turbine performance.

Turning now to the drawings and referring first to FIG. 1, a block diagram of an embodiment of a turbine system 10 is illustrated. The diagram includes a prefilmer 11, a fuel nozzle 12, a heat source 13, a fuel supply 14, a temperature controller 15 and a combustor 16. The fuel supply 14 routes a liquid fuel and/or gas fuel, such as natural gas, to the turbine system 10 through the fuel nozzle 12 into the combustor 16. Although the turbine system 10 may combust gas fuel alone or in combination with liquid fuel, the following discussion focuses on liquid fuels. As depicted, fuel nozzle 12 includes the prefilmer 11 and the heat source 13, which may be coupled to the temperature controller 15. The prefilmer 11 may improve liquid fuel vaporization and atomization by impinging liquid fuel streams upon surfaces, thereby breaking up the liquid fuel, thinning fuel across the surfaces, and shedding droplets of the liquid fuel from an edge of the surfaces. The heat source 13, such as a heating coil, may be utilized along with the prefilmer 11 to control the conditions near the prefilmer 11 to enhance vaporization and reduce coking. For example, the temperature controller 15, such as a processor with executable code on memory, may be used to control a temperature of the heat source 13, located on or near the prefilmer 11, to provide optimal fuel vaporization, fuel atomization, fuel air mixing, and so forth.

After mixing with pressurized air, shown by arrow 18, ignition occurs in the combustor 16 and the resultant exhaust gas causes blades within a turbine 20 to rotate. The coupling between the blades and shaft 22 will cause rotation of shaft 22, which is also coupled to several components throughout the turbine system 10, as illustrated. For example, the illustrated shaft 22 is drivingly coupled to a compressor 24 and a load 26. As appreciated, the load 26 may be any suitable device to generate power via the rotational output of the turbine system 10, such as a power generation plant or a vehicle.

Air supply 28 may route air via conduits to an air intake 30, which then routes the air into the compressor 24. Compressor 24 includes a plurality of blades drivingly coupled to shaft 22, thereby compressing air from the air intake 30 and routing it to fuel nozzles 12 and the combustor 16, as indicated by arrows 32. Fuel nozzle 12 may then mix the pressurized air and fuel, shown by numeral 18, to produce an optimal mix ratio for combustion, e.g., a combustion that causes the fuel to more completely burn so as not to waste fuel or cause excess emissions. After passing through the turbine 20, the exhaust gases exit the system at an exhaust outlet 34. As discussed in detail below, an embodiment of the turbine system 10 includes certain structures and components (e.g., prefilmers 11 and heat sources 13) within the fuel nozzle 12 to improve air and fuel mixing, while preventing coking buildup within the nozzle 12.

Figure 2:
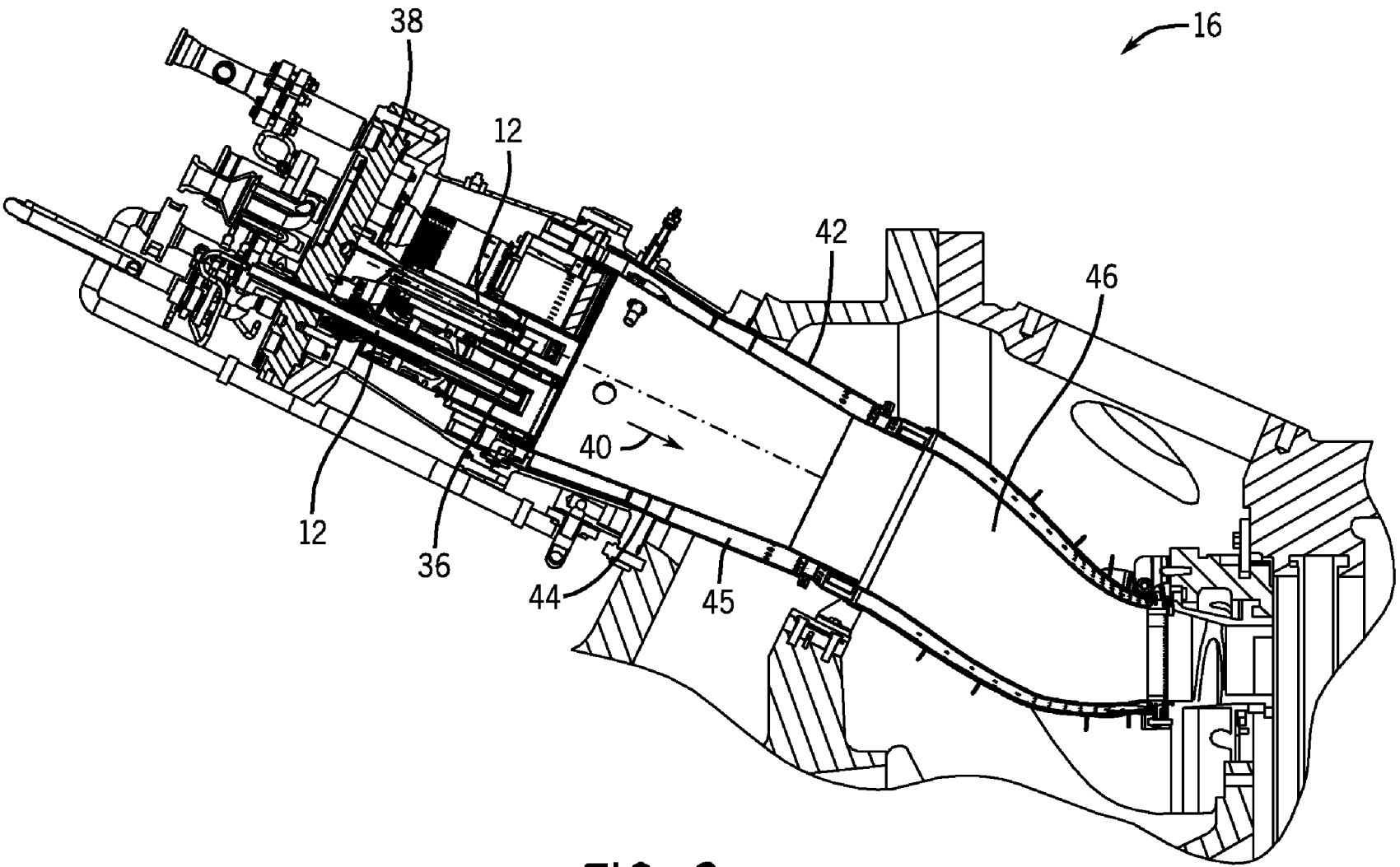
FIG. 2 is a cutaway side view of the combustor, as shown in FIG. 1, with a plurality of fuel nozzles coupled to an end cover in accordance with an embodiment of the present technique.

FIG. 2 shows a cutaway side view of an embodiment of combustor 16 having a plurality of fuel nozzles 12 with prefilmers 11 and heat sources 13. As depicted, each fuel nozzle 12 includes a fuel nozzle tip 36 configured to direct fuel and air in a downstream direction. In an embodiment, combustor 16 may feature five or more fuel nozzles 12 that may be mounted to an end cover 38, which is located at the base or head end of combustor 16. The end cover 38 may include conduits or channels that route liquid fuel, gas fuel, air, water, diluents, and other fluids to each fuel nozzle 12. Each fuel nozzle 12, along with each prefilmer 11 and heat source 13, facilitates mixture of pressurized air and liquid fuel as it is directed in a direction 40 to the combustor 16. The air fuel mixture then combusts in the combustor 16, thereby creating hot pressurized exhaust gases, which drive the rotation of blades within the turbine 20. Combustor 16 includes a flow sleeve 42 and a liner 44 surrounding the combustion zone in the combustor 16 cavity. In certain embodiments, the flow sleeve 42 and liner 44 are coaxial or concentric with one another to define a hollow annular space 45, which may enable passage of air for cooling and entry into the combustion zone (e.g., via perforations in liner 44 and/or via fuel nozzles 12). Liner 44 also may be designed to control the flow and speed of the air fuel mixture and hot exhaust gases downstream in the direction 40 toward a transition piece 46. For example, the air fuel mixture may exit each fuel nozzle 12 in direction 40, wherein the mixture ignites as it enters the combustor liner 44 causing pressurized exhaust gas to be routed downstream 40 through the transition piece 46 into the turbine 20. As appreciated, the arrangement of the prefilmer 11 and heat source 13 within the fuel nozzle 12 enables improved control over the vaporization and atomization of liquid fuel, while also reducing or preventing coking. Thus, as discussed below, the prefilmer 11 and heat source 13 enable an improved air/fuel mixture process within the combustor 16.

As described in detail below, a fuel stream may be directed to impinge upon the prefilmer 11, in any one of a plurality of embodiments and locations, and is then atomized via intersection with one or more air flow streams. In certain embodiments, the liquid fuel may be spread out evenly in a thin film across the prefilmer 11 surface. In turn, the thin film of liquid fuel may both vaporize and shed from an edge of the surface. As appreciated, the spreading as a thin film increases the surface area of the liquid fuel, thereby increasing vaporization. The thinning also reduces the liquid fuel thickness at the edge, thereby resulting in smaller fuel droplets shedding from the edge. Thus, the thinning and shedding creates improved liquid fuel atomization. In one embodiment, the liquid fuel may be directed into a swirling air flow from a swozzle, which causes the fuel to accelerate and evenly distribute across the prefilmer surface in a thin, continuous sheet. The air flow streams may then cause the thin fuel sheet to quickly vaporize and atomize (e.g., via shedding) and form a fuel air mixture, suitable for combustion downstream in the combustor 16.

Figure 3:
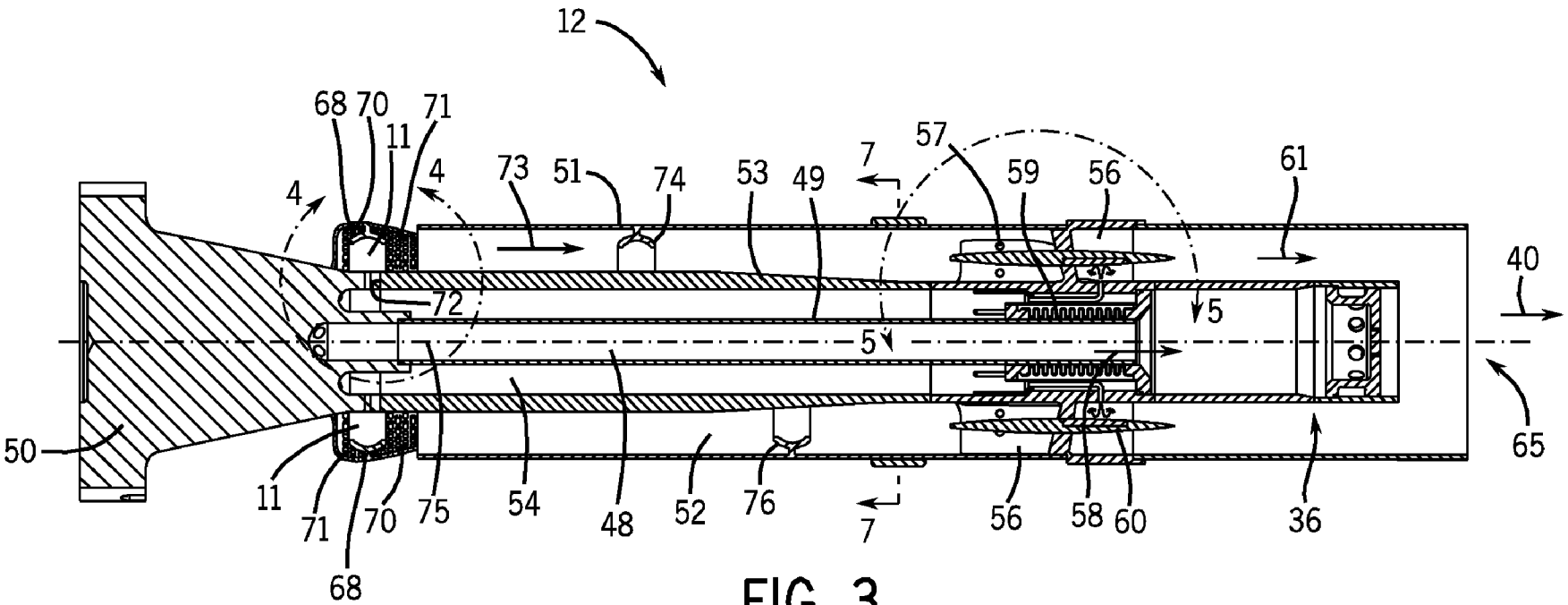
FIG. 3 is a cross-sectional side view of a fuel nozzle, as shown in FIG. 2, with a plurality of fuel prefilmers, in accordance with an embodiment of the present technique.

A cross-section side view of an embodiment of the fuel nozzle 12 is shown in FIG. 3. The fuel nozzle 12 includes an embodiment of the prefilmer 11, located in an upstream position within the nozzle 12 (i.e., relative to flow direction 40). Further, compressed air may be routed from the compressor 24 to a compressed air passage 48, within a tube 49, through the end cover 38 and a flange 50. The flange 50 may be coupled to the end cover 38 via a suitable coupling mechanism, such as a weld or bolts. An outer tubing 51 may be described as or include an annular flow conditioner, which conditions pressurized air as it flows downstream within a compressed air passage 52. As illustrated, the compressed air passage 52 is an annular passage between concentric tubing 51 and 53. The fuel nozzle 12 further includes a fuel passage 54, which is the annular passage between concentric tubing 49 and 53. Thus, passages 48, 52 and 54 are arranged coaxial with one another and thus are each annular in shape. The cavities within the passages may be hollow areas within the annular tubes, which may be configured to allow fluid flow and air-fuel mixtures. Passages 48, 52 and 54 are defined by the inner-tube 49, outer-tubing 51 and intermediate-tubing 53. Fuel from the fuel passage 54 is directed to a swozzle 56 via vane holes 57.

In addition, pressurized air flows in a downstream direction 58, through a bellows tube 59, which directs air into the fuel nozzle tip 36. Air may be routed from the air passage 52 through the swozzle 56 where the air may be mixed with fuel. A downstream prefilmer 60 may be located near the swozzle 56 to improve the air fuel mixture. As depicted, the downstream prefilmer 60 may be located within the annulus of passage 52 and coupled to the swozzle 56 (i.e. a swirl inducing structure), wherein the fuel and air may mix after passing through the various annulus passages 48, 52 and 54, before mixing near downstream prefilmer 60 and flowing in a downstream direction 61 out of the fuel nozzle 12. In one embodiment, the prefilmer 60 is either coupled to, coaxial or concentric with, or generally in proximity to the swirler or swozzle 56. As air exits the fuel nozzle tip 36, a swirling air/fuel mixture, caused by the swozzle 56 and the downstream prefilmer 60, flows with the air. Specifically, the downstream prefilmer 60, along with an active heat control, including the heat source 13, enhances flow and mixing of the fuel and air as they flow in the downstream direction 61 toward the combustor 16. As may be appreciated, the depicted downstream prefilmer 60 is one of many embodiments of a prefilmer that may be used along with an active heat control mechanism to improve and control air-fuel mixing.

For example, in an embodiment, either the prefilmer 11 in an upstream location and/or the downstream prefilmer 60 may be located within the fuel nozzle 12. Specifically, in an embodiment, the nozzle 12 may contain one prefilmer 11, including either one or several members, without any additional prefilmers. For example, the fuel nozzle 12 may contain just one prefilmer assembly, such as the downstream prefilmer 60, to enhance air and fuel mixture and to control the temperature of the air and fuel within the fuel nozzle 12. The temperature control and prefilmer geometry provide improved fuel atomization and fuel-air mixing conditions, which improve turbine efficiency as the mixture flows downstream through a nozzle end 65, into the combustor 16. Further, temperature control provided by the heat source 13 may reduce coking within the nozzle 12 by maintaining a temperature of at least approximately 500, 600, 700, 800, 900, or 1000 degrees F. or greater.

As depicted, the prefilmer 11 is located in an upstream portion (e.g., relative to flow direction 40) of the nozzle 12 and includes a structure with a curved cross-section 68. The curved cross-section 68 of the prefilmer 11 is an annular structure oriented to enhance the air fuel mixture in the annular cavities of the upstream portion of the fuel nozzle 12. Air may flow in the nozzle 12 through a plurality of holes 70 located throughout a flow conditioner 71 (e.g., a perforated annulus), which is located in the upstream portion of the fuel nozzle 12. As described herein, the term upstream may be a direction or location near or toward the flange 50, while downstream may be in a direction 40 toward the combustor 16. The upstream flow conditioner 71 may also be described as an annulus, wherein the cross-sectional shape 68 of the prefilmer 11 may be concentric to the flow conditioner 71. Thus, the air may flow through the air holes 70 and mix with fuel from a fuel conduit 72 directed toward the prefilmer 11. The curved shape of the prefilmer 11 enables the fuel to be more easily atomized and/or vaporized after impinging the surface of the prefilmer 11, thereby improving the performance of the fuel nozzle 12. As described below, the prefilmer 11 may include an active heat control mechanism to enable management of the temperature and boundary conditions near the prefilmer, such as viscosity of the liquid fuel and frictional co-efficient as the fuel flows within the fuel nozzle 12. The active heat control mechanism may include any suitable components, such as a heating coil, conduits for flowing hot/cold fluid (e.g., compressed air, combustion gases, etc.), components to heat the flowing air, or any combination thereof. As discussed herein, the prefilmer is one or more structures configured to break up a fluid to improve atomization and mixing process. In particular, embodiments of the prefilmer accomplish this by promoting a thin film of liquid, which subsequently breaks while shedding from a thin downstream edge.

The air and fuel mixture may flow in a downstream direction 73 toward a downstream prefilmer 74. In the depicted embodiment, the prefilmer 74 is a member that includes a curved cross-section and may be located on only a portion of the circumference of the annulus within the fuel nozzle 12. For example, the prefilmer 74 may include several members in spaced relation circumferentially about a longitudinal axis 75 of the fuel nozzle 12. For example, in an assembly with three prefilmer 74 members, each of the prefilmer members may span a circumferential distance of approximately 60 degrees of the circumference of the annulus area within the flow conditioner 51. In another embodiment, several members of the prefilmer 74 may be staggered along the axis 75 within the fuel nozzle 12, thereby enabling temperature management and air and fuel mixture management in several axial locations. For example, the prefilmer may include a prefilmer member 76, which may be staggered in an axial direction downstream from the prefilmer member 74 along the axis 75.

Additionally, each of the prefilmer members 74 and 76 may span a circumferential distance of approximately 60 degrees. In an embodiment, one or more additional prefilmer members may be disposed at different axial positions, each spanning approximately 60 degrees within the cavity 52.

In certain embodiments, the fuel nozzle 12 may include 1, 2, 3, 4, 5, 6, 7, 8, 9, 10, or more prefilmer members at a particular axial position along the axis 75, wherein the prefilmer members may be a single annular structure or discrete members spaced apart from one another about the axis 75. Likewise, the fuel nozzle 12 may include one or more prefilmer members at 1, 2, 3, 4, 5, 6, 7, 8, 9, 10, or more different axial positions along the axis 75. In certain embodiments, the prefilmer members may be staggered (e.g., angularly offset from one another relative to the axis 75) in multiple axial locations within a cavity of the fuel nozzle 12 to enable greater control over the fuel mixing and temperature within the nozzle 12. For example, the prefilmers from one axial location to another may be staggered by an angle (e.g., about axis 75) of approximately 5, 10, 15, 20, 25, 30, 35, 40, or 45 degrees. The prefilmer and temperature control enable increased fuel atomization, vaporization, and fuel-air mixing conditions as the fuel air mixture flows downstream into the combustor 16, while also reducing or preventing coking associated with the liquid fuel.

Figure 4:
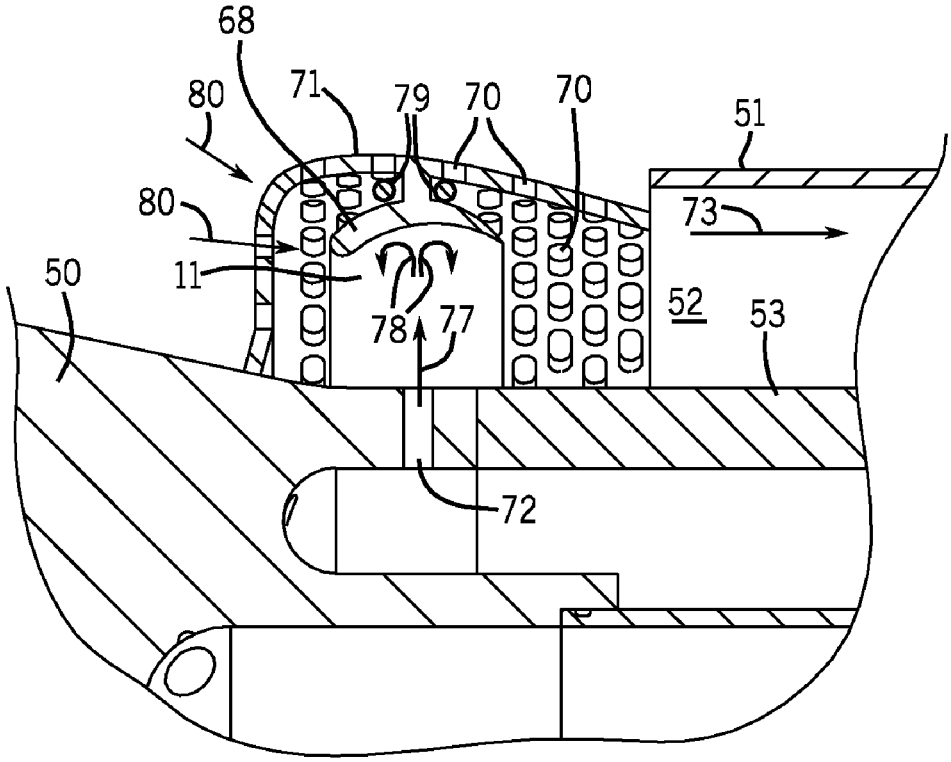
FIG. 4 is a cross-sectional side view of a prefilmer, flow conditioner, and heat control, taken within line 4-4 as shown in FIG. 3, in accordance with an embodiment of the present technique.

FIG. 4 is a cross-sectional side view of the upstream portion of the fuel nozzle 12, taken within line 4-4 as shown in FIG. 3. The fuel nozzle 12 includes the upstream flow conditioner 71 and the prefilmer 11. The prefilmer 11 includes the curved cross-section 68 (e.g., C-shaped annular surface), which enables improved atomization and vaporization of the fuel as the fuel is emitted in a direction 77 from the fuel outlet 72. For example, arrows 78 show the direction of fuel flow after impinging the surface of the curved cross-section 68. Further, the prefilmer 11 and heat control mechanism may control the amount of liquid fuel vaporized, wherein the amount of fuel vaporized may be optimized to improve a mixing process. The impinged fuel stream 78 may break up into droplets, improving atomization and vaporization, thereby improving the mixing process. The prefilmer 11 also may spread a thin layer of liquid fuel along the curved cross-section 68, which in turn sheds liquid droplets from an edge. The fuel thinning across the curved cross-section 68 may increase liquid fuel vaporization due to the increased surface area, while the thinning may also reduce the droplet size shedding from the edge of the curved cross-section 68. In other embodiments, the cross-section of the prefilmer 11 may be flat, air foil-shaped, angular, stepped, or any appropriate geometry that enhances atomization.

In addition, the prefilmer 11 includes a heat source 79, which may be used to manage the temperature on or around the surface of the prefilmer 11. The heat source 79 may include an electric heating element, such as a resistive heating element, convective heat transfer from another source, or any suitable source of heat. For example, the heat source 79 may include an inductive heating coil. The active heat control provided by the heat source 79 enables management of the viscosity of the liquid fuel and enables a management of the temperature of the area near prefilmer 11, where air and fuel are mixed. The heat source 79 also inhibits, reduces, removes, or generally prevents coking by maintaining a suitable temperature, e.g., at least greater than approximately 500, 600, 700, 800, 900, or 1000 degrees F., which prevents formation of coke deposits within the fuel nozzle 12. Further, the temperature needed to reduce coke deposits may depend on fuel composition, system components and other factors. Accordingly, in some embodiments the heat source may maintain a prefilmer area temperature of at least greater than approximately 700, 750, 800, 850, 900, 950, or 1000 degrees Fahrenheit to inhibit coking. In addition, in case of formation of coke deposits, the heat source 79 may be heated to a suitable temperature, e.g., at least greater than approximately 900, 950, 1000, 1050, or 1100 degrees F., to burn off coke deposits and buildup within the nozzle 12.

The active heat control provided by the heat source 79 enables control of the surface of the prefilmer 11 and/or the area around the prefilmer 11. Further, the temperature may be maintained by continuously powering the heat source 79 or may be periodically heated by cycling power to the heat source 79. Such control operations may be performed by the temperature controller 15, as depicted in FIG. 1. The temperature control 15 may include a processor, circuitry, memory and software configured to control the temperature on and around the prefilmer 11 within the fuel nozzle 12. In addition, the active heat control and heat source 79 may be utilized for any of the disclosed embodiments of prefilmers, regardless of their shape, location or configuration. As depicted, an air flow 80 enters the upstream flow conditioner 71 through air holes 70, enabling a mixture between the vaporized and/or atomized liquid fuel and the air flow 80. The improved mixing and vaporization provided by the active heat management and prefilmer 11 enables improved performance and flow of the mixture as it travels in the downstream direction 73 toward the combustor 16.

Figure 5:
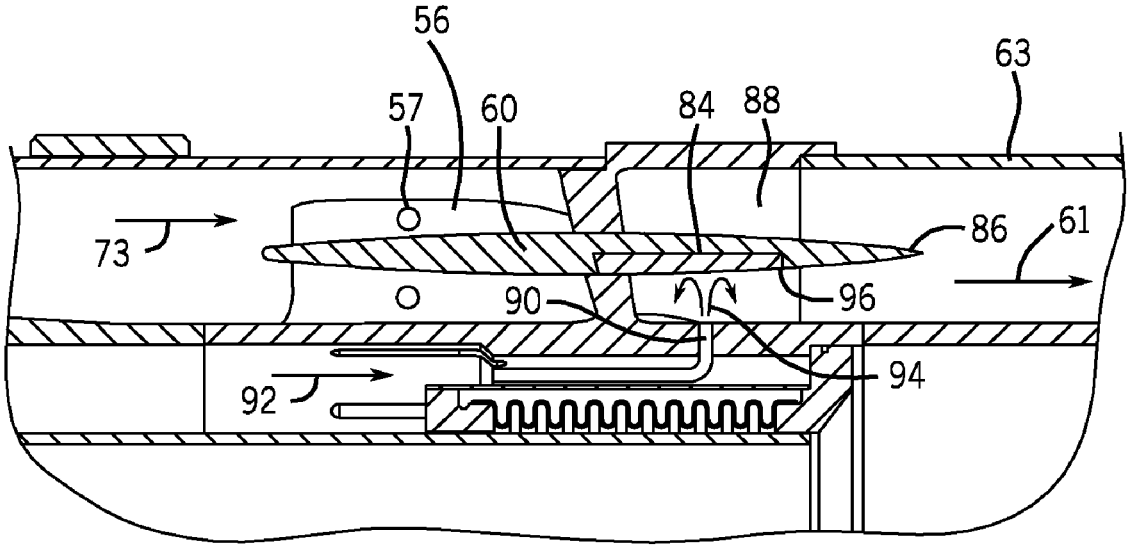
FIG. 5 is a cross-sectional side view of a prefilmer, flow conditioner, and heat control, taken within line 5-5 as shown in FIG. 3, in accordance with an embodiment of the present technique.

FIG. 5 is a cross-sectional side view of a downstream embodiment of the downstream prefilmer 60, taken within line 5-5 as shown in FIG. 3. In the depicted embodiment, the downstream prefilmer 60 includes a heating element 84, which is a heat source configured to enable improved temperature management of the air and fuel mixing process on and/or near the prefilmer 60. The heating element 84 may include a coil and other heating and control components as discussed above with respect to heating element 79. In addition, the prefilmer 60 provides a geometry with a downstream trailing edge 86 that enables atomization and vaporization of the liquid fuel, providing an enhanced environment for an air/fuel mixture. For example, a thin film of liquid fuel may shed from the downstream trailing edge 86, thereby creating small droplets attributed to the fuel thinning and air flow. The geometry of the prefilmer 60 may be described as an airfoil shaped profile. In certain embodiments, the prefilmer 60 has an annular geometry with the airfoil shaped profile 360 degrees about the axis. In other words, we could either have a series of discrete airfoils, or a continuous annular structure with an airfoil shape.

In addition, the downstream air flow 73 may enter the swozzle 56 via air holes 57, where the swozzle airfoils 88 enable a swirling of the air/fuel mixture as the fuel exits a fuel port 90. For example, a fuel stream 92 may travel in a downstream direction through the fuel port 90 and may impinge as shown by arrows 94 against a prefilmer surface 96 of the prefilmer 60. The atomization of liquid fuel includes a conversion of a liquid into a spray or mist (e.g., a distribution of droplets), which occurs as the fuel stream 94 impinges the surface 96 and the fuel sheds from the edge 86. Atomization is important to efficient combustion and can result in a higher combustion efficiency of the fuel and reduced emissions. Vaporization includes the process of a phase transition of the liquid fuel to a gas. Either atomization or vaporization may be improved by the disclosed embodiments of prefilmers and active heat control devices. Improvements in atomization or vaporization may lead to improved mixing of air and fuel, thereby improving combustion performance. For example, the active heat control provided by the heating element 84 enables a management of the temperature of the prefilmer surface 96, improving the atomization and vaporization of the impinged fuel flow 94 to improve the mixture of fuel and air. Accordingly, the improved mixture may result in an improved combustion within the turbine combustor. In addition, the temperature management provided by the heating element 84 reduces or eliminates coking within the fuel nozzle 12 and specifically on the downstream prefilmer 60.

Figure 6:
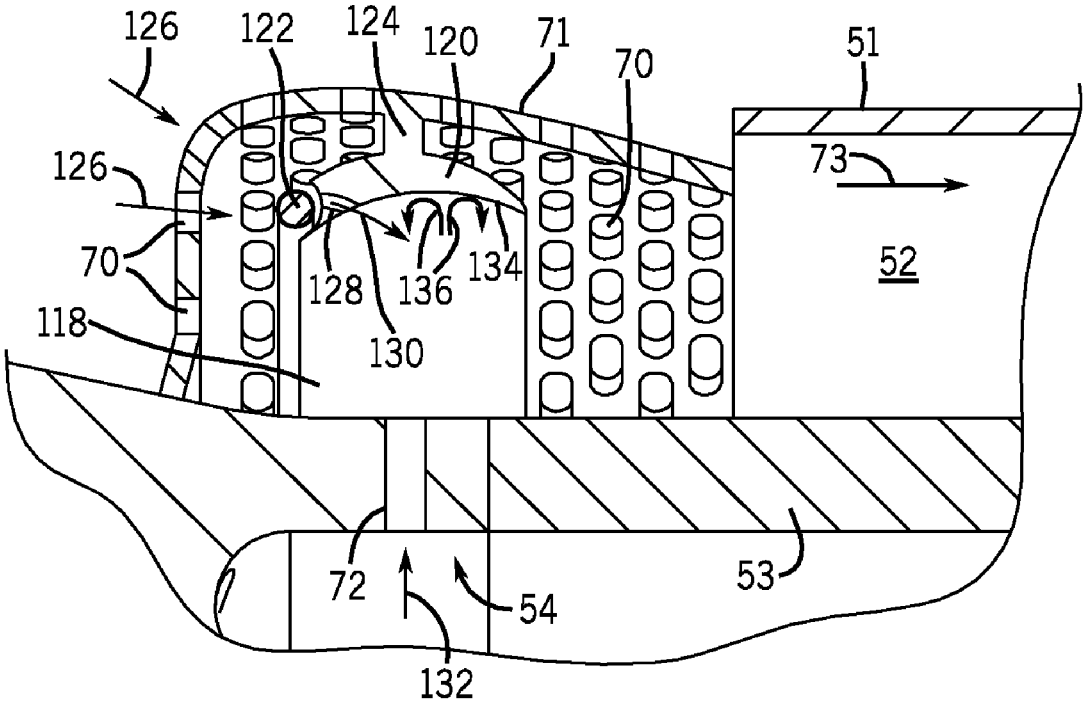
FIG. 6 is a cross-sectional side view of another embodiment of a prefilmer and heat source coupled to a swirler, as shown in FIG. 4.

FIG. 6 is a cross-sectional side view of another embodiment of a prefilmer 118, rather than prefilmer 11, taken within line 4-4 as shown in FIG. 3. In particular, the illustrated prefilmer 118 includes a curved cross-section 120 with a notch or cavity for a heating source 122. In the depicted embodiment, the curved cross-section 120 may be described as concentric to the curved cross-section of the upstream flow conditioner 71. In other words, the curved-cross-section 120 may have a C-shaped cross-section, which extends 360 degrees about the axis 75 to define a full annulus within the annular shaped flow conditioner 71. Further, the heating source 122 may be placed within a notch of the curved cross-section 120 of the prefilmer 118. In certain embodiments, the heating source 122 may be a circular or annular shaped heating element or coil, wherein the annular heating source 122 in the form of a heating element or coil, may be placed within an annular shaped notch of the curved prefilmer cross-section 120.

The heating source 122 is used to perform active heat control near the prefilmer 118 and may be coupled to the upstream flow conditioner 71 via any suitable mechanism such as a pin 124 or a weld. As discussed above, the heating source 122 may be coupled to a control mechanism, such as a processor and memory with instructions to control the temperature of the area near the prefilmer 118. As depicted, the heat source 122 is positioned to control a temperature of an air flow 126 into the flow conditioner 71 and/or the curved cross-section 120.

The air flow 126 is directed through holes 70 into the flow conditioner 71. As the air flow 126 passes around the heating source 122, it travels through a passageway 128 in the curved cross-section 120. A heated air flow 130 may impinge upon, and intersect with, a fuel mist inside the prefilmer 118. The fuel may flow from the flange 50 in a direction 132 through the fuel port 72 into a chamber within the flow conditioner 71. The fuel flow 132 may impinge upon a prefilmer inner-surface 134, causing the fuel flow to be redirected, as shown by arrows 136. Accordingly, the atomized liquid fuel, broken up into droplets, may mix with the heated air flow 130 to provide an enhanced mixture of air and fuel.

In addition, the liquid fuel may spread across the surface 134 of the curved cross-section 120, and then shed from an edge of the surface 134 to create liquid fuel droplets. Again, the thinning across the surface 134 may increase liquid fuel vaporization due to the increased surface area, while also reducing the droplet size shedding from the edge due to the decreased thickness of the thin fuel film. In the disclosed embodiments, the heating source 122, either directly or indirectly via the heated air flow 130, heats the surface 134 to further increase liquid fuel vaporization and reduce or eliminate coking.

Thus, the mixing process is improved and controlled by the heating source 122 and the prefilmer 118. The air and fuel mixture may flow in the downstream direction 73 to the end of the nozzle 12 for injection into the combustor 16. As such, the improved fuel and air mixture may increase combustion efficiency of the turbine 10, reducing emissions and improving power output.

Figure 7:
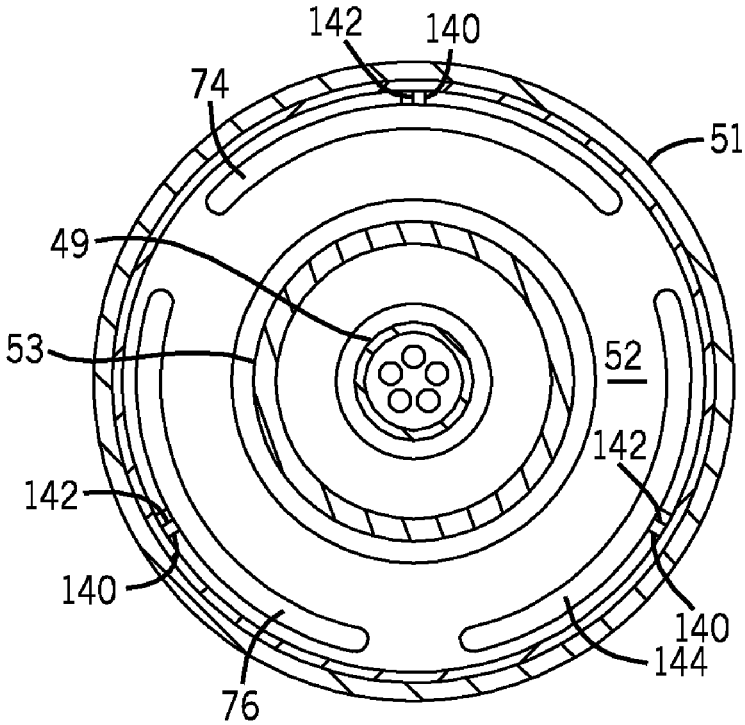
FIG. 7 is a cross-sectional end view of a fuel nozzle, taken along line 7-7 as shown in FIG. 3, including a plurality of fuel prefilmers, in accordance with an embodiment of the present technique.

FIG. 7 is a cross-sectional end view in a center portion of an embodiment of the fuel nozzle 12, taken along line 7-7 as shown in FIG. 3. As depicted, the nozzle 12 includes the flow conditioner tube 51, intermediate tubing 53, and the cavity 52 between the tubes 51 and 53. The cavity 52 includes a prefilmer assembly that is comprised of several members or individual prefilmers. The individual prefilmers are coupled to the inter-portion of the flow conditioner 51 via braces or brackets 140, which may contain conductive heating elements 142 used to provide a heating source to the prefilmers 74, 76, and 144. The prefilmers 74, 76, and 144 are circumferentially spaced apart about the cavity 52, wherein each of the prefilmer spans approximately 100 degrees of the circumference of the cavity 52. The prefilmer members 74, 76, and 144 may be identical shape and structure, wherein the cross-section of the prefilmer members is curved, as shown in FIG. 3. In other embodiments, the cross-section of the prefilmer members 74, 76, and 144 may be substantially flat or may include other cross-sectional geometries, such as shown in FIG. 6. Further, the prefilmer members 74, 76, and 144 may be axially staggered, as shown in FIG. 3, or may all be positioned at substantially the same axial position.

The prefilmers 74, 76, and 144 may also include a variety of methods for heat control, such as convective heat transfer, conductive heat transfer, or radiative heat transfer from a local heat source or remote heat source. The geometry of the prefilmers 74, 76, and 144, along with the heating source 142, may provide improved conditions for air and fuel mixing as the fuel and air flow in a downstream direction 73, toward the nozzle end 65. Therefore, the improved air and fuel mixture may improve performance, reduce emissions, and reduce buildup of coking within the fuel nozzle 12. Coking may be prevented by maintaining a temperature above approximately 500, 600, 700, 800, 900, or 1000 degrees F. as the air and fuel mix prior to flowing into the combustor 16. Moreover, the heating source, including conducting heating elements 142, may enable a heating of the prefilmers 74, 76, and 144 above a temperature of 900, 950, 1000, 1050, or 1100 degrees F. to remove any coking buildup that may occur within fuel nozzle 12.

Figure 8:
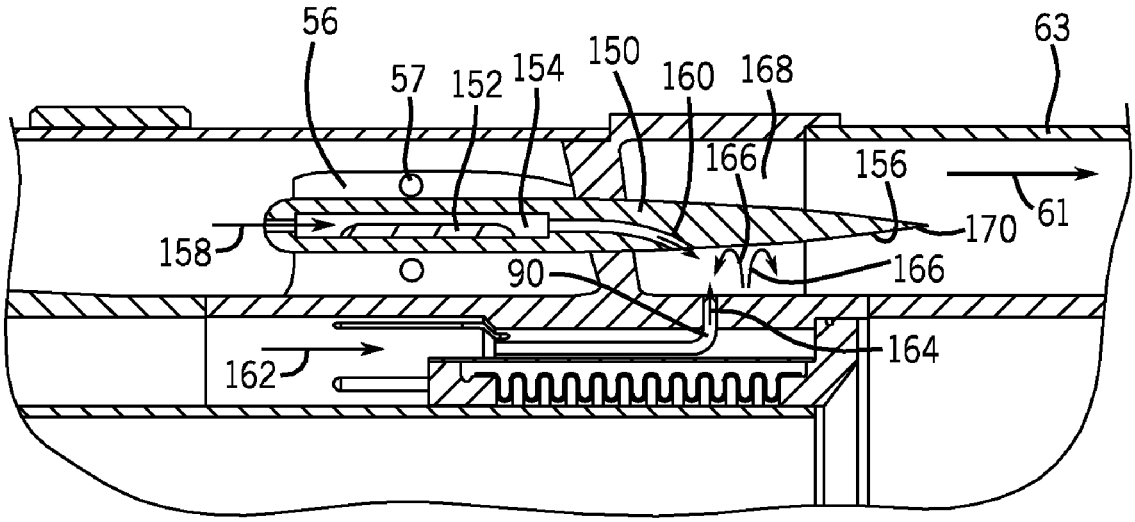
FIG. 8 is a cross-sectional side view of another embodiment of a prefilmer and heat source coupled to a swirler, as shown in FIG. 5.

FIG. 8 is cross-sectional side view of another embodiment of a downstream portion of the fuel nozzle 12 with an example of a downstream prefilmer 150, taken within line 5-5 as shown in FIG. 3. The portion of the fuel nozzle 12 includes the downstream prefilmer 150 located in the portion of the fuel nozzle containing the swozzle 56 and vane holes 57. The downstream prefilmer 150 may include a heat source 152, such as a heating coil, located in a cavity 154 within the prefilmer 150. The prefilmer 150 may have a cross-section generally shaped like an air foil, with a prefilmer surface 156. An air flow 158 may flow into the cavity 154 through a port 160. As such, the air flow 158 may be heated by the heating element 152 prior to exiting the cavity 154 via the port 160. Fuel may flow, as depicted by arrow 162, through the fuel port 90 into a cavity 168, as shown by arrow 164. The air and fuel flows from ports 90 and 160, respectively, may intersect, or impinge on one another, to produce an air and fuel mixture. Moreover, the fuel flow 164 may impinge on the prefilmer surface 156, as shown by arrows 166. The impingement upon the surface 156 may produce droplets of liquid fuel, thereby improving an atomization of the fuel and improving mixture process prior to a mixture flow in the downstream direction 61.

In addition, the fuel flow 164 spreads the fuel in a thin film across the surface 156, thereby improving liquid fuel vaporization and droplet shedding from a downstream trailing edge 170 of the surface 156. For example, the fuel spreads across a greater surface area to increase vaporization, while simultaneously decreasing the fuel thickness to decrease the size of droplets shedding from the edge 170. In addition, the heat source 152 increases the rate of liquid fuel vaporization, while also reducing or eliminating coking associated with the liquid fuel. Thus, the heat source 152 and downstream prefilmer 150 provide improved management of the air-fuel mixing process to provide increased combustion efficiency and reduce or eliminate coking within the fuel nozzle 12. Specifically, the temperature management and improved atomization provided by the depicted prefilmer geometry and flow arrangements of air and fuel provide an improved fuel-air mixture.

Technical effects of the invention include reduced emissions and improved turbine efficiency, due to the prefilmer geometry in combination with the heat control provided by the nozzle embodiments. The prefilmer and heat control may enable improved atomization and vaporization, enhancing the air-fuel mixture. Further, the heat control may also reduce coking within the nozzle. For example, by maintaining a temperature of above approximately 500, 600, 700, 800, 900, or 1000 degrees F. near the prefilmer, coke accumulation is significantly reduced. Moreover, the heat control mechanisms may cause the prefilmer area temperature to rise above 900, 950, 1000, 1050, or 1100 degrees F., in order to burn off any coking that may occur in the structure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a turbine engine, comprising:

a turbine;

a combustor;

a compressor; and a fuel nozzle disposed in the combustor, wherein the fuel nozzle comprises: an air passage defined by an inner tube and an outer tube; at least one prefilmer disposed in a region of the air passage radially between the inner tube and the outer tube; and a heat source disposed within the region of the air passage, wherein the prefilmer is configured to control fuel vaporization, coking, or a combination thereof.

2. The system of claim 1, wherein the heat source comprises an active heat control configured to actively control temperature in the fuel to adjust a rate of the fuel vaporization and reduce the coking.

3. The system of claim 1, wherein the heat source comprises an electric heating element or convective heat transfer from another source.

4. The system of claim 1, wherein the heat source is configured to maintain a temperature of the at least one prefilmer to a target value within a range of approximately 700 to 1000 degrees Fahrenheit.

5. The system of claim 1, wherein the fuel nozzle comprises a swirler, and the at least one prefilmer is upstream of the swirler relative to a direction of flow through the fuel nozzle.

6. The system of claim 1, wherein the heat source is coupled to the at least one prefilmer, the at least one prefilmer comprises a cross-sectional shape that is curved, and the at least one prefilmer and the heat source are disposed inside a perforated annulus of a flow conditioner.

7. The system of claim 1, wherein the at least one prefilmer is coupled to a swirler inside the fuel nozzle.

8. The system of claim 7, wherein the heat source is inside an airfoil shaped profile of the at least one prefilmer.

9. The system of claim 7, wherein the heat source comprises a heated air passage through a portion of the at least one prefilmer.

10. A system, comprising: a fuel nozzle comprising: an air passage defined by an inner tube and an outer tube; a fuel prefilmer configured to create a fuel film that sheds fuel in the fuel nozzle; and a heat source configured to control fuel vaporization and coking associated with the fuel prefilmer; wherein the fuel prefilmer and the heat source are disposed within a region of the air passage radially between the inner tube and the outer tube.

11. The system of claim 10, wherein the fuel prefilmer comprises a plurality of annular members located around a circumference of an annulus of the fuel nozzle.

12. The system of claim 11, wherein the plurality of annular members are staggered axially along the annulus.

13. The system of claim 10, wherein the fuel prefilmer is inside the fuel nozzle upstream from a swirler relative to a flow direction through the turbine fuel nozzle.

14. The system of claim 13, comprising a perforated annular flow conditioner disposed about the fuel prefilmer, wherein the fuel prefilmer comprises an annular geometry having a curved cross-section facing a fuel port.

15. The system of claim 10, wherein the fuel prefilmer is coupled to a swirler inside the fuel nozzle.

16. The system of claim 15, wherein the fuel prefilmer comprises an air foil-shaped cross-section.

17. The system of claim 10, wherein the heat source is configured to maintain a temperature of at least greater than approximately 700 degrees Fahrenheit on a surface of the fuel prefilmer.

18. A system, comprising: a turbine engine fuel nozzle, comprising: an air path between an inner wall and an outer wall, wherein the outer wall extends around the inner wall; a fuel path; a prefilmer disposed in a region of the air path spaced between the inner wall and the outer wall, wherein the fuel path is directed toward the prefilmer; and a heat source configured to heat the prefilmer, wherein the heat source is disposed within the region of the air path.

19. The system of claim 18, comprising a controller coupled to the heat source, wherein the controller is configured to adjust the heat source to maintain a temperature of at least greater than approximately 700 degrees Fahrenheit.

20. The system of claim 18, comprising a controller coupled to the heat source, wherein the controller is configured to adjust the heat source to a target temperature to reduce coking and control fuel vaporization.

* * * * *